US005959405A

United States Patent [19]

Soules et al.

[11] Patent Number: 5,959,405

[45] Date of Patent: Sep. 28, 1999

[54] ELECTRODELESS FLUORESCENT LAMP

[75] Inventors: Thomas F. Soules, Richmond Heights; Joseph Darryl Michael, University Heights, both of Ohio; David O. Wharmby, Ilkley, United Kingdom

[73] Assignee: General Electric Company, Schenectady, N.Y.

[21] Appl. No.: 08/746,354

[22] Filed: Nov. 8, 1996

[51] Int. Cl.[6] ..... H01J 65/04

[52] U.S. Cl. ..... 313/635; 313/113; 313/493

[58] Field of Search ..... 313/113, 634, 313/635, 317, 493; 315/248

[56] References Cited

U.S. PATENT DOCUMENTS

| | | | |
|---|---|---|---|
| 3,987,334 | 10/1976 | Anderson | 315/248 |
| 4,652,790 | 3/1987 | Wood | 313/112 |
| 5,187,412 | 2/1993 | El-Hamamsy et al. | 315/248 |
| 5,378,965 | 1/1995 | Dakin et al. | 315/248 |
| 5,412,280 | 5/1995 | Scott et al. | 313/573 |
| 5,412,288 | 5/1995 | Borowiec et al. | 315/248 |
| 5,412,289 | 5/1995 | Thomas et al. | 315/248 |
| 5,434,482 | 7/1995 | Borowiec et al. | 315/248 |
| 5,461,284 | 10/1995 | Roberts et al. | 315/57 |
| 5,500,567 | 3/1996 | Wilson et al. | 313/490 |
| 5,519,285 | 5/1996 | Ukegawa et al. | 313/634 |
| 5,654,610 | 8/1997 | Cassarly et al. | 315/248 |

FOREIGN PATENT DOCUMENTS

| | | | |
|---|---|---|---|
| 0 586 180 | 3/1994 | European Pat. Off. | H01J 65/04 |
| 0 660 376 | 6/1995 | European Pat. Off. | H01J 65/04 |
| 2057601 | 7/1996 | United Kingdom . | |

*Primary Examiner*—Michael Day
*Attorney, Agent, or Firm*—Pearne Gordon, McCoy and Granger LLP

[57] ABSTRACT

An electrodeless fluorescent lamp having an envelope with an improved shape. The invented shape is shorter and the light-trapping area near the neck is substantially reduced or eliminated. The ratio of the operational width to the operational height of the envelope is preferably at least 1.5 and the reflector face angle is preferably less than 40°.

19 Claims, 2 Drawing Sheets

ELECTRODELESS FLUORESCENT LAMP

BACKGROUND OF THE INVENTION

1. Field of the Invention

The invention relates generally to electrodeless fluorescent lamps and more particularly to an improved shape for the envelope of an electrodeless fluorescent lamp.

2. Description of Related Art

In the prior art electrodeless fluorescent, or low pressure gas discharge, lamp illustrated generally in FIG. 1, an induction coil inserted into the lamp cavity drives a magnetically induced plasma discharge which circulates around the coil around the axis of the lamp in the direction of the electric field created by the oscillating current and essentially in the direction of the coil windings.

Because the coil is necessarily not very large, e.g. less than 2 cm in diameter, and because the discharge is close to the coil for good coupling, the effective arc length is small, on the order of less than 10 cm compared with about 60 cm for typical 20–25 watt compact fluorescent lamps (CFL) with electrodes. Hence, to have a 20–25 watt lamp, the arc current must be very high, about 3.5–4.0 A compared to 0.16–0.32 A for typical CFLs. A large arc cross sectional area must be allowed since if the current is constricted by the walls of the discharge then there will be a high current density with a significant decrease in efficiency due to wall losses. Also, there will be a further loss in light output as a function of time due to a high ion bombardment rate on the wall coating.

The prior art electrodeless fluorescent reflector lamp illustrated generally by FIG. 1 has the shape of a standard, R80, blown bulb incandescent reflector lamp. The top is a semi-prolate ellipsoid with the major axis being about 80 mm. The flattened ellipsoid is connected with a radius of curvature to a paraboloid reflector shape forming the base or reflector face of the lamp. This paraboloid reflector region is designed to focus light from an incandescent filament into the forward direction. However, when used as the reflector region for an electrodeless fluorescent lamp, it is covered first with a diffuse reflector and then a phosphor powder coating. A capped cylindrical glass tube (52 mm×26.5 mm) is inserted into the base of the reflector bulb and sealed to it. This covers the ferrite induction coil which drives the plasma discharge. See FIG. 1.

Since the bulb is fairly large and much larger than the inserted cylindrical glass tube, the prior art design does allow a relatively large cross section for the plasma discharge. However, being designed as an incandescent reflector lamp it is not optimized for maximum efficiency for an electrodeless discharge lamp.

There is a need for a shorter lamp with an improved shape. A shorter lamp will allow the maximum overall height of the lamp plus ballast to be the same as for a standard incandescent R80 bulb, insuring that it does not protrude out of fixtures made for the latter. Reducing the height of the bulb will allow more room for electronic ballast components where space is at a premium. Furthermore, by reducing the height of the lamp one also reduces the amount of glass and phosphor materials required to make the lamp.

Simply scaling down the height of the prior art lamp, however, would constrict the discharge and reduce its efficiency significantly. There is a need for a new shape for the bulb, which allows the height of the bulb to be reduced without significantly reducing efficiency or increasing wall loading.

SUMMARY OF THE INVENTION

An electrodeless fluorescent lamp comprising a vitreous light-transmissive envelope containing mercury and an inert gas is provided, the envelope being shaped with an external chamber for receiving an electrical excitation circuit. The excitation circuit is present in the external chamber of the envelope and is effective for exciting the mercury to emit electromagnetic radiation with electromagnetic fields that are passed through the envelope from outside, to inside, the envelope. The lamp further comprises a circuit for supplying electrical power from power mains to the excitation circuit. The envelope has an operational width and an operational height, the ratio of the operational width to the operational height being at least 1.5.

DETAILED DESCRIPTION OF THE PREFERRED EMBODIMENTS

Figure 1:
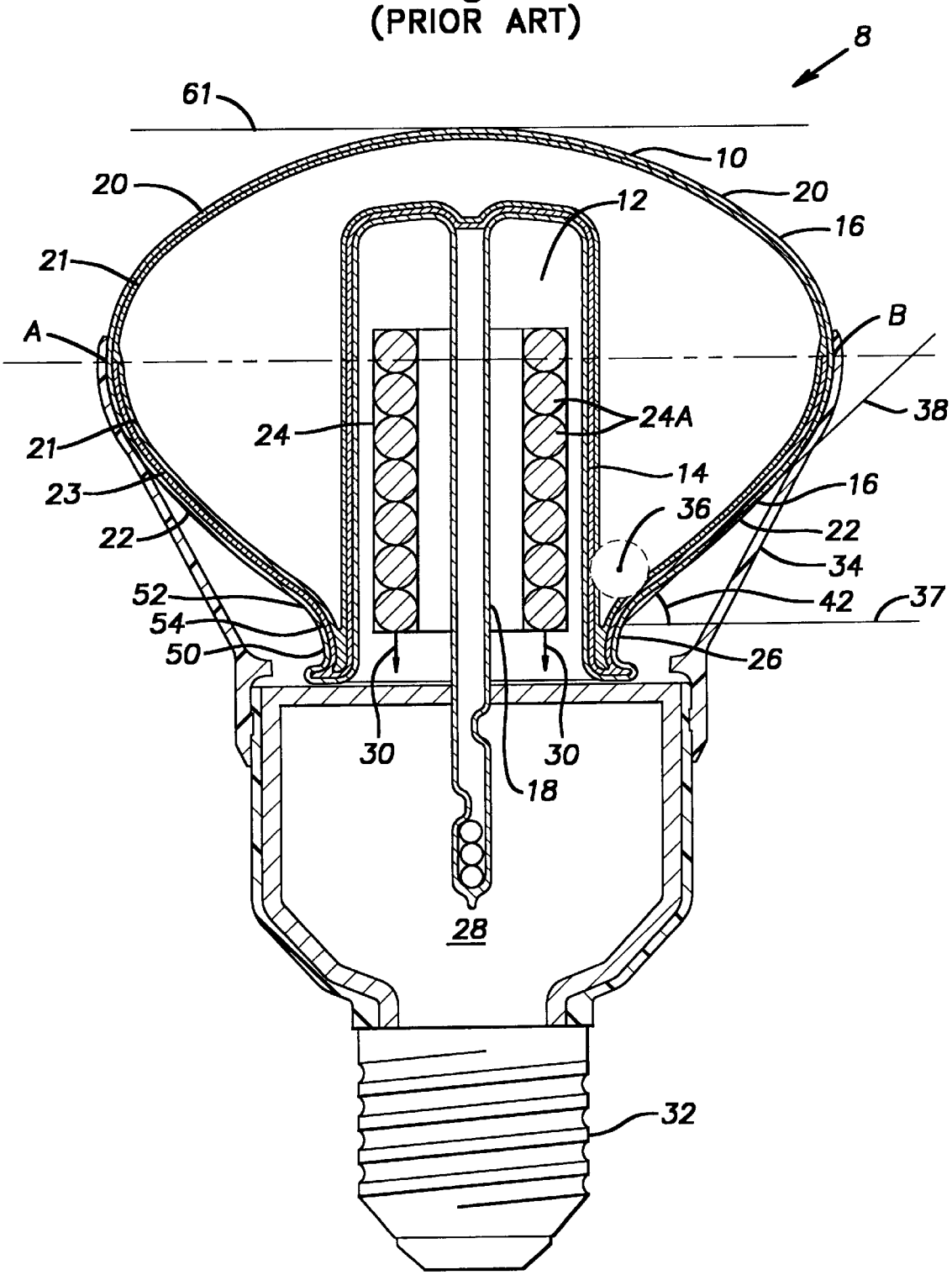
Fig.1 (PRIOR ART)
FIG. 1 is an elevational view in cross section of an electrodeless fluorescent lamp showing the shape of the prior art envelope.

With reference to FIG. 1, there is shown an electrodeless fluorescent lamp 8 which illustrates the shape of the prior art envelope 10. The general construction and operation of electrodeless fluorescent lamps is known in the art and the contents and drawings of U.S. Pat. Nos. 5,412,280; 5,500,567; 5,461,284; 5,434,482; 5,412,288; and 5,412,289 are incorporated herein by reference in their entirety. Lamp 8 includes a sealed light-transmissive envelope or vitreous envelope 10, such as soda-lime-silicate glass, that is hermetically sealed and that contains mercury and an inert gas, such as argon or krypton. Envelope 10 has a bulbous portion 16, a central column 14 arising from the bottom of the bulbous portion 16, and an exhaust tube 18 depending from the top of column 14. Envelope 10 is shaped with an external chamber 12 for receiving an electrical excitation circuit or electrical excitation coil 24 which is effective for exciting the mercury to emit electromagnetic radiation or ultraviolet light or light with or by means of electromagnetic fields that are passed through the envelope from outside, to inside, the envelope. Coil 24 is shown with coil turns 24A whose cross sections are exaggerated in size. Coil 24 has a cylindrical shape, and a hollow interior through which exhaust tube 18 of vitreous envelope 10 extends. Coil 24 is electrically coupled to power supply, or ballast, circuit 28 via conductors 30, only part of which are shown; ballast circuit 28 is shown in schematic form as merely a block. Ballast circuit 28, in turn, is coupled to receive alternating current power from power mains or electrical supply means via a screw-type base 32. Thus the lamp has a circuit for supplying electrical power from power mains to the excitation circuit. Plastic skirt 34 helps to protect vitreous envelope 10 and hold it in position.

In FIG. 1 a center line A-B has been drawn through the widest part of bulbous portion 16 from Point A to Point B to help describe the invention. Line A-B is defined as the width center line. Above line A-B is top face 20 of bulbous portion 16 and below line A-B is reflector face 22 of bulbous portion 16. As discussed above, in FIG. 1 the reflector face is paraboloid while in FIG. 2 it is not. As is known in the art, inner conductive coatings, outer conductive coatings and other such coatings or precoats may be applied to envelope 10, and the interior surfaces or surfaces facing the plasma discharge of reflector face 22 and central column 14 are coated with a reflective layer 23 of titania or alumina and thereafter the interior surfaces or surfaces facing the plasma discharge of top face 20, reflector face 22 and central column 14 are coated with or have disposed thereon a phosphor coating or layer 21.

Figure 2:
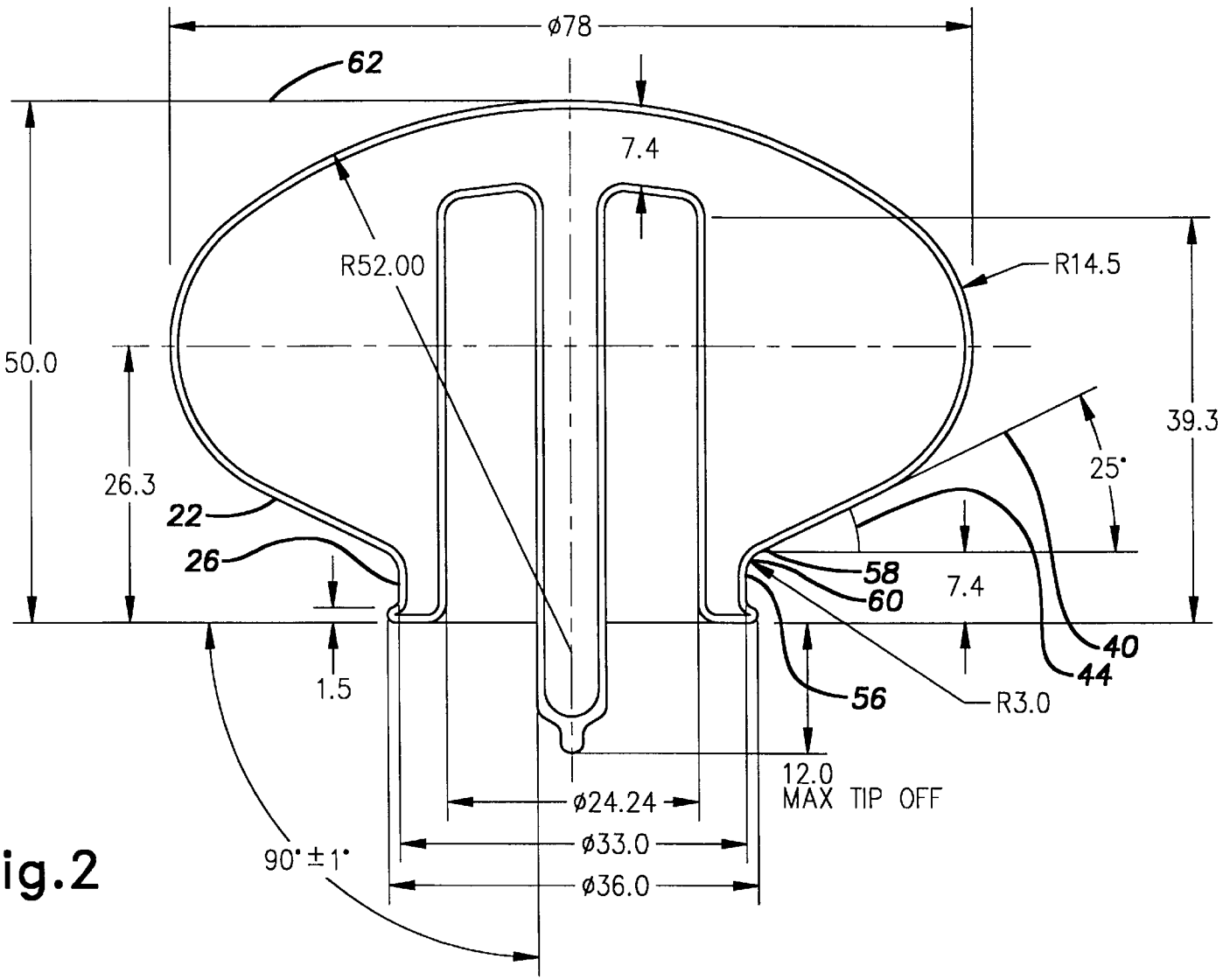
FIG. 2 is an elevational view in cross section of the invented envelope of an electrodeless fluorescent lamp showing the improved shape and noting the preferred dimensions in millimeters.

FIG. 2 shows the new invented shape for the envelope of an electrodeless fluorescent lamp. Other than for shape, the envelope of FIG. 2 functions in an electrodeless fluorescent lamp in the same manner in which the envelope 10 of FIG. 1 operates. FIG. 2 shows that the shape of the envelope, particularly the bulbous portion of the envelope, has been changed.

As shown in FIGS. 1 and 2, the envelope 10 has a neck 26. The top of the neck is defined by a concave surface which blends the neck into the lower portion of the reflector face 22. In a cross sectional view, this concave surface defines an arc, which has a first end, a second end, and a midpoint. In FIG. 1, these are shown at 50, 52, and 54, respectively, and in FIG. 2 are shown at 56, 58, and 60, respectively. The vertical distance from that midpoint 54, 60 (on the outside of the envelope) to the horizontal line or plane tangent to the top of the envelope (see lines 61 and 62 in FIGS. 1 and 2, respectively) defines the operational height of the envelope. The operational width of the envelope is defined as the horizontal distance between a vertical plane tangent to the outermost portion of the envelope and a second vertical plane tangent to the outermost portion on the opposite side of the envelope. In other words, the operational width is the length of the widest portion of the envelope or the length of the width center line from one side of the envelope to the opposite side of the envelope. In the prior art this distance is about 79 mm and is shown in FIG. 1 as the distance from A to B.

In the invented envelope of FIG. 2, preferably the operational height of the envelope is 43.2 mm and the operational width is 78 mm. In the invented envelope of FIG. 2, the ratio of the operational width to the operational height is preferably at least 1.5, more preferably at least 1.6, more preferably at least 1.7, more preferably at least 1.8, and preferably 1.5 to 2.7, more preferably 1.6 to 2.3, more preferably 1.7 to 1.95, more preferably about 1.8, and more preferably about 1.804. With respect to the prior art envelope of FIG. 1, the operational height of the envelope is 55.56 mm, the operational width is 79.3 mm, and the ratio of the operational width to the operational height is 1.43.

The lower or bottom portion of the reflector face, viewed elevationally in cross section, substantially defines a straight line. See the straight lines 38 and 40 in FIGS. 1 and 2, respectively. This straight line forms or defines an angle with the horizontal called the reflector face angle; see angles 42 and 44 in FIGS. 1 and 2, respectively. In FIG. 2 the reflector face angle is 25°; in the invented envelope the reflector face angle is preferably less than 40°, more preferably less than 37°, more preferably less than 35°, more preferably less than 32°, more preferably less than 30°, more preferably less than 27°, and preferably 40°–0°, more preferably 37°–5°, more preferably 35°–10°, more preferably 32°–15°, more preferably 30°–20°, more preferably 28°–22°, more preferably 26°–24°, and more preferably about 25°. In the prior art of FIG. 1, the reflector face angle is about 43°.

With reference to FIG. 1, the vertical distance between width center line A-B and the horizontal line or plane 61 tangent to the top of the envelope defines the top face height and the vertical distance from midpoint 54 (on the outside of the envelope) to center line A-B is defined as the reflector face height. In other words, the width center line divides the operational height into a top face height and a reflector face height. The top face height plus the reflector face height equals the operational height. As shown in FIG. 2, preferably the top face height is about 23.7 mm, and the reflector face height is about 19.6 mm, and in the invented envelope the ratio of the top face height to the reflector face height is preferably at least 0.95, more preferably at least 1, more preferably at least 1.05, more preferably at least 1.1, more preferably at least 1.15, more preferably at least 1.2, and preferably 0.95 to 2.0, more preferably 1 to 1.8, more preferably 1.05 to 1.6, more preferably 1.1 to 1.4, more preferably 1.15 to 1.25, more preferably about 1.2, and more preferably about 1.21. In FIG. 1, the ratio of the top face height to the reflector face height is about 0.89. The envelope of FIG. 2 is a flattened ellipsoidal shape, that is, the operational width is greater than two times the top face height.

In the invented envelope the ratio of 1) one half the operational width to 2) the top face height is preferably at least 1.54, more preferably at least 1.56, more preferably at least 1.58, more preferably at least 1.6, more preferably at least 1.62, more preferably at least 1.64, and preferably 1.54–2.5, more preferably 1.56–2.25, more preferably 1.58–2.0, more preferably 1.6–1.8, more preferably 1.62–1.7, more preferably 1.64–1.66, and more preferably about 1.648. In FIG. 1, the ratio of 1) one half the operational width to 2) the top face height is about 1.52.

In the invented envelope (see FIG. 2), the shape is substantially that of an ellipsoid having a major axis of 78 mm, a minor axis of about 47.3 mm, which yields a ratio of major axis to minor axis of 1.648. In the invented envelope, the shape is substantially that of an ellipsoid whose ratio of major axis to minor axis is preferably at least 1.54, more preferably at least 1.56, more preferably at least 1.58, more preferably at least 1.6, more preferably at least 1.62, more preferably at least 1.64, and preferably 1.54–2.5, more preferably 1.56–2.25, more preferably 1.58–2.0, more preferably 1.6–1.8, more preferably 1.62–1.7, more preferably 1.64–1.66, and more preferably about 1.648.

One problem with the prior art is that light would tend to get trapped in the region shown in FIG. 1 as dashed area 36, where the light gets multiply reflected and dissipated. The invented shape substantially reduces or eliminates this light-trapping area, and the light gets reflected out in the upward (outward) direction.

The new shape of the bulbous portion of the envelope is approximately that of a complete prolate ellipsoid looking like a flattened sphere. The new shape fits around the discharge approximately following an outer surface of low constant electron density. Hence, wall loading is spread more uniformly over the surface, and the surface does not restrict the discharge in some regions and provide "dead" space in others. Unlike the prior art shape of FIG. 1, the bottom reflector region of the invented envelope is not a tapered parabola and there is very little neck region which is not filled by the discharge. By substantially removing the neck region, the bulb is shorter and there is less light loss due to light trapped between the reflector and the central column 14.

A range of shapes from a bulbous top and flat bottom to the reverse were simulated using a computer model. A second calculation was performed on each shape to calculate reflection losses from light bouncing between the reflector, central column and top face. These calculations confirmed that the prolate ellipsoid shape of the present invention was an optimal design for ultraviolet efficiency over this range of shapes. The calculations also quantified the dimensions of this shape and predicted that the height of the lamp could be decreased by 16 mm with only about a 1.5% loss of light output—a 3.5% loss in UV output partly compensated by a 1.7% gain with less reflection losses with the smaller central column and possibly a small additional unquantified gain due to less light trapping between the reflector and the central column. The other 16 mm shorter shapes lost more UV efficiency.

Actual lamps have been made with the shape of FIG. 2, and little or no loss in light output is evident from the shape change, even though the height of the lamps had been reduced from 60 mm to about 45 mm, or about 25%.

Although the preferred embodiments of the invention have been shown and described, it should be understood that various modifications and rearrangements may be resorted to without departing from the scope of the invention as disclosed and claimed herein.

What is claimed is:

1. A low pressure electrodeless fluorescent lamp comprising a vitreous light-transmissive envelope containing mercury and an inert gas, a phosphor layer within said envelope, said envelope being shaped with an external chamber for receiving an electrical excitation circuit, said excitation circuit being present in said external chamber of said envelope and being effective for exciting said mercury to emit electromagnetic radiation with electromagnetic fields that are passed through said envelope from outside, to inside, said envelope, a circuit for supplying electrical power from power mains to said excitation circuit, said envelope having a convexly curved surface having an apex near the center, said envelope having a reflector face having a reflective layer disposed thereon, said envelope having a flattened ellipsoidal shape and having an operational width and an operational height, said operational height divided into a top face height and a reflector face height by a width center line, the ratio of said operational width to said operational height being at least 1.5 and the ratio of one half said operational width to said top face height being at least 1.54.

2. A lamp according to claim 1, wherein said ratio of said operational width to said operational height is from 1.5 to 2.7.

3. A lamp according to claim 2, wherein said ratio of said operational width to said operational height is from 1.6 to 2.3.

4. A lamp according to claim 3, wherein said ratio of said operational width to said operational height is from 1.7 to 1.95.

5. A lamp according to claim 4, wherein said ratio of said operational width to said operational height is about 1.8.

6. A lamp according to claim 1, wherein said ratio of one half said operational width to said top face height is from 1.56 to 2.25.

7. A lamp according to claim 1, wherein said ratio of one half said operational width to said top face height is from 1.64 to 1.66.

8. A low pressure electrodeless fluorescent lamp comprising a vitreous light-transmissive envelope containing mercury and an inert gas, a phosphor layer within said envelope, said envelope being shaped with an external chamber for receiving an electrical excitation circuit, said excitation circuit being present in said external chamber of said envelope and being effective for exciting said mercury to emit electromagnetic radiation with electromagnetic fields that are passed through said envelope from outside, to inside, said envelope, a circuit for supplying electrical power from power mains to said excitation circuit, said envelope having a convexly curved surface having an apex near the center, said envelope having a reflector face having a reflective layer disposed thereon, the lower portion of said reflector face defining a reflector face angle, said reflector face angle being less than 40°.

9. A lamp according to claim 8, wherein said reflector face angle is less than 35°.

10. A lamp according to claim 9, wherein said reflector face angle is less than 30°.

11. A lamp according to claim 10, wherein said reflector face angle is about 25°.

12. A lamp according to claim 8, wherein said envelope has a flattened ellipsoidal shape and has an operational width and an operational height, said operational height divided into a top face height and a reflector face height by a width center line, the ratio of one half said operational width to said top face height being at least 1.54.

13. A low pressure electrodeless fluorescent lamp comprising a vitreous light-transmissive envelope containing mercury and an inert gas, a phosphor layer within said envelope, said envelope being shaped with an external chamber for receiving an electrical excitation circuit, said excitation circuit being present in said external chamber of said envelope and being effective for exciting said mercury to emit electromagnetic radiation with electromagnetic fields that are passed through said envelope from outside, to inside, said envelope, a circuit for supplying electrical power from power mains to said excitation circuit, said envelope having a reflector face having a reflective layer disposed thereon, said envelope having a flattened ellipsoidal shape and having an operational width and an operational height, said operational height divided into a top face height and a reflector face height by a width center line, the ratio of said top face height to said reflector face height being at least 0.95 and the ratio of one half said operational width to said top face height being at least 1.54.

14. A lamp according to claim 13, wherein said ratio of said top face height to said reflector face height is from 0.95 to 2.0.

15. A lamp according to claim 14, wherein said ratio of said too face height to said reflector face height is from 1 to 1.8.

16. A lamp according to claim 15, wherein said ratio of said top face height to said reflector face height is from 1.1 to 1.4.

17. A lamp according to claim 15 , wherein said ratio of said top face height to said reflector face height is about 1.2.

18. The lamp according to claim 13, wherein said ratio of one half said operational width to said top face height is from 1.56 to 2.25.

19. The lamp according to claim 18, wherein said ratio of one half said operational width to said top face height is from 1.64 to 1.66.

* * * * *